US007517274B2

(12) United States Patent
Santucci

(10) Patent No.: US 7,517,274 B2
(45) Date of Patent: Apr. 14, 2009

(54) MIRROR IMAGE PAIR SANDING BLOCKS

(76) Inventor: Gerard Santucci, 20 Franklin Blvd. - Apt 105, Long Beach, NY (US) 11561

( * ) Notice: Subject to any disclaimer, the term of this patent is extended or adjusted under 35 U.S.C. 154(b) by 42 days.

(21) Appl. No.: 11/581,130

(22) Filed: Oct. 13, 2006

(65) Prior Publication Data

US 2008/0090496 A1 Apr. 17, 2008

(51) Int. Cl.
*B24B 23/00* (2006.01)

(52) U.S. Cl. ..... 451/28; 451/524; 451/557

(58) Field of Classification Search ..... 451/523, 451/524, 525, 552, 555, 557, 558, 354
See application file for complete search history.

(56) References Cited

U.S. PATENT DOCUMENTS

| | | | | |
|---|---|---|---|---|
| 1,599,906 | A * | 9/1926 | McKnight | 451/503 |
| 1,782,577 | A * | 11/1930 | Maris | 451/515 |
| 2,680,334 | A | 6/1954 | Howard | 51/187 |
| 4,593,427 | A | 6/1986 | Ortolivo | 15/227 |
| 5,016,402 | A | 5/1991 | Reiter | 51/393 |
| 5,054,248 | A | 10/1991 | Thayer | 51/392 |
| 5,134,809 | A | 8/1992 | Morton | 51/391 |
| 5,313,746 | A | 5/1994 | Zarriello | 51/358 |
| 5,533,926 | A | 7/1996 | Nemazi | 451/490 |
| 5,662,519 | A * | 9/1997 | Arnold | 451/525 |
| 5,718,622 | A | 2/1998 | Jones | 451/524 |
| 5,885,148 | A | 3/1999 | Vargas | 451/523 |
| 6,267,658 | B1 | 7/2001 | Ali | 451/523 |

FOREIGN PATENT DOCUMENTS

GB 2 368 776 A 5/2002

* cited by examiner

*Primary Examiner*—Robert Rose
(74) *Attorney, Agent, or Firm*—Alfred M. Walker

(57) ABSTRACT

A right handed or left handed sanding block can be provided individually or as a mirror image pair. Each block includes a grasp handle and a fastening surface engaging a replaceable sanding pad. Each handle includes a pair of cove box channels to fit the fingers of the user. These channels have forward and rear finger stops located at opposite sides. The channel positions are mirror image reversed for the right hand and left hand blocks. The forward stop provides a rest for the thumb and the front vertical surface provides a rest for the index finger. A rear finger stop provides a rest for a tip of another finger. The block is a truncated rectangle with an offset edge. The short side of the block provides a safety harbor clearance when the other hand of the user grasps the work piece.

17 Claims, 2 Drawing Sheets

MIRROR IMAGE PAIR SANDING BLOCKS

FIELD OF THE INVENTION

The present invention relates to a mirror image pair sanding blocks which provide ease of grasping by either the left hand or the right hand, while providing other-hand clearance during manual grasping a workpiece.

BACKGROUND OF THE INVENTION

The prior art reveals a variety of sanding blocks. A sampling of such prior art includes U.S. Pat. No. 6,267,658 of Ali which shows a rectangular sanding block base with a raised channeled handle oriented diagonally relative to the base; the handle is symmetric with respect to right hand or left hand use. U.S. Pat. No. 5,313,746 of Zarriello, U.S. Pat. No. 5,718,622 of Jones, and U.S. Pat. No. 5,533,926 of Nemazi reveal sanding blocks with triangular shapes and symmetric pointed fronts. All of these patents show sanding blocks which are symmetric with respect to the left or right side of the pad. The sanding block of U.S. Pat. No. 5,054,248 of Thayer shows an asymmetric body molded of a flexible cellular polyurethane foam to provide bottom regions of varying rigidity to permit sanding flat or slightly contoured surfaces.

None of the prior art patents reveal a mirror image pair of sanding blocks each uniquely formed for ease of grasping by the left hand or the right hand respectively while providing other-hand clearance while grasping a workpiece.

OBJECTS OF THE INVENTION

It is therefore an object of the present invention to provide a mirror image pair of sanding blocks each uniquely formed for ease of grasping by the left hand or the right hand respectively while providing other-hand clearance while grasping a workpiece.

It is also an object of the present invention to provide a convenient sanding block for either the right or left hand, wherein the block is uniquely formed for ease of grasping by the hand, while providing other-hand clearance while grasping a workpiece.

It is also an object of the present invention to provide one or more sanding blocks which utilizes fine manual control of fine abrasion without annoying fatiguing slipping or wobbling of the tool in the user's hand and which promotes accurate sanding of material.

Other objects which become apparent from the following description of the present invention.

SUMMARY OF THE INVENTION

This invention is a mirror image pair of right-hand and left-hand sanding blocks with grasp handles to fit the respective right or left hand of a user. The grasp handle of each block has a pair of cove box channels to fit the fingers of the user. The cove box channels have forward and rear finger stops, but the forward stop is on the opposite side of the handle from the rear stop, and the channel positions are reversed for the right hand and left hand sanding blocks.

The invention also discloses a respective block designed for either the right or left handed persons respectively, instead of being a set of mirror image blocks.

In use, the forward stop of each of the two blocks defines a natural resting position for the thumb. The front vertical surface of each grasp handle is a natural rest position for the index finger. The rear finger stop is a natural rest position for the tip of the fourth or of the smallest (fifth) finger depending on the preference of the user's grasping technique. The benefit of using the grasp handle of this invention is the extra fine manual control of fine abrasion without annoying fatiguing slipping or wobbling of the tool in the user's hand.

In addition, each base of these mirror image pair of sanding blocks is in the shape of a rectangle with the front end cut off preferably at about a 45 degree angle. The short side of each sanding block coincides with the side of the grasp handle on which the thumb rests. This provides other-hand clearance when the "other hand" is issued to grasp the work piece. Due to ease of grasping, the user does not require fine motor control in both hands to use this pair of mirror image sanding blocks for fine finish sanding. While the preferable shape is a truncated rectangle, it is anticipated that some curvature can be provided to the outer peripheral edges, especially at the rear edge.

Each of the sanding blocks preferably uses a fastening surface, such as for example a bonded bottom hook surface or other material gripping surface, to use replaceable sanding pads with integral loop material for hook and loop fastening. The preferred material of the sanding blocks of this invention is a fastened assembly of two wooden parts, base and grasp handle. An alternative material other than wood can be metal or non-metallic plastics, such as, for example, integrally molded plastic resin, which can also be used to fabricate each sanding block.

Preferably, the pair of mirror image sanding blocks for manual fine abrasion, includes a right handed sanding block and a left handed sanding block, which are mirror images thereof. The can be provided as a set, or can be provided individually as a single block for either a right handed or left handed user.

While either the left-hand or the right-hand block is designed to be specifically used with the intended hand of a user, it will not be impossible for a user to use the sanding blocks of the current invention with the unintended hand.

The sanding block of the present invention should preferably have a thickness of about three quarters of an inch.

Further, the sanding block may be used when turned on its side, so that it will produce a squared abrasion to a job piece. For this function, of course, the abrasive would be attached not only to the bottom of the block but also to the left side, right side or rear side, as needed. Convenient user attachment and detachment of abrasive sheets is conventional and may be accomplished by many methods, including a hook and loop fastener system where the hooks and loops are alternately applied either to the block or to the back of the abrasive sheet so as to facilitate adherence.

Further to the nature of this invention, the front end is angled for the purpose of allowing the block to clear the user's hand that is grasping the job piece being worked upon. Squared-off sanding blocks do not allow the manual fine control of the present invention. The angled front side thus provides abrasive on the forward-projecting angled bottom surface of the block, while the forward area not occupied by the block due to its angling comprises a safety harbor. The safety harbor allows movement of the angled tip portion of the block into close proximity with the job pieces of varied contours while allowing the user's hand grasping the job piece to remain out of the way in the safety harbor.

The right handed sanding block hand tool is specifically for use with the user's right hand, including:

a) an elongated longitudinally disposed grasp handle which has a sanding block extending downwardly therefrom, the block having a substantially rectangular shape with parallel respective left and right sides, and wherein the left side is shorter than the right side and the right side is longer than the left side, the block having a rear side extending between and perpendicular to the shorter left side and the longer right side;

b) the block has an angled forward side extending between the shorter left side and the longer right side wherein an acute angle is subtended between the angled forward side and the longer right side of the block; and wherein:

c) the block has a generally rectangular-shaped flat bottom, the flat bottom being bordered by the shorter left side, the longer right side, the rear side and the angled forward side; the flat bottom having the hook portion of loop and hook fastener means mounted thereupon for accepting a sheet of matching-shaped abrasive wherein the abrasive is provided with the loop portion of the hook-and-loop fastener means for removable attachment of the abrasive to the flat bottom of the block; and wherein:

d) the longitudinal grasp handle is generally disposed substantially at the mid-point between the shorter left side and the longer right side and is generally disposed parallel to the sides; and wherein:

e) the grasp handle is generally shaped as a rectangular block having a narrow rear side, a narrow longitudinally elongated top side and elongated and vertically wide left and right sides extending between a forward side of the handle to the rear side so as to fit comfortably in the right hand of a user; and wherein:

f) the grasp handle vertically wide left and right sides have respective longitudinally disposed cove box channels therein for comfortably accepting the fingers of a user's right hand; and wherein the cove box channels are located substantially in the vertical center of the vertical width of the respective grasp handle left and right sides; and wherein:

g) the cove box channels extend between a forward end and a rear end, the cove box channel forward and rear ends corresponding with the forward and rear sides of the longitudinal grasp handle; and wherein:

the left side cove box channel has a comfortable stop near its forward end and the right side cove box channel has a comfortable finger stop near its rear end so that the user's right thumb fits comfortably into the left side cove box channel and the user's choice of the remaining fingers 2, 3, 4, and 5 fit comfortably into the right side cove box channel, the left side cove stop for stopping the user's right thumb and the right side cove box channel for stopping the user's chosen right finger 3, 4 or 5;

Likewise, the left handed sanding block is specifically for use with the user's left hand, including:

h) an elongated longitudinally disposed grasp handle has a sanding block extending downwardly therefrom, the block having a substantially rectangular shape with parallel respective left and right sides, and wherein the right side is shorter than left side and the left side is longer than the right side, the block having a rear side extending between and perpendicular to the shorter right side and the longer left side;

i) the block has an angled forward side extending between the shorter right side and the longer left side wherein an acute angle is subtended between the angled forward side and the longer left side of the block; and wherein:

j) the block has a generally rectangular-shaped flat bottom, the flat bottom being bordered by the shorter right side, the longer left side, the rear side and the angled forward side; the flat bottom having the hook portion of loop and hook fastener means mounted thereupon for accepting a sheet of matching-shaped abrasive wherein the abrasive is provided with the loop portion of hook-and-loop fastener means for removable attachment of the abrasive to the flat bottom of the block; and wherein:

k) the longitudinal grasp handle is generally disposed substantially at the mid-point between the shorter right side and the longer left side and is generally disposed parallel to the sides; and wherein:

l) the grasp handle is generally shaped as a rectangular block having a narrow rear side, a narrow longitudinally elongated top side and elongated and vertically wide left and right sides extending between a forward side of the handle to the rear side so as to fit comfortably in the left hand of a user; and wherein:

m) the grasp handle vertically wide left and right sides have respective longitudinally disposed cove box channels therein for comfortably accepting the fingers of a user's left hand; and wherein the cove box channels are located substantially in the vertical center of the vertical width of the respective grasp handle left and right sides; and wherein:

n) the cove box channels extend between a forward end and a rear end, the cove box channel forward and rear ends corresponding with the forward and rear sides of the longitudinal grasp handle; and wherein:

o) the right side cove box channel has a comfortable stop near its forward end and the left side cove box channel has a comfortable finger stop near its rear end so that the user's left thumb fits comfortably into the right side cove box channel and the user's choice of remaining left hand fingers 2, 3, 4, and 5 fit comfortably into the left side cove box channel, the right side cove stop for stopping the user's left thumb and the left side cove box channel for stopping the user's chosen left finger 3, 4 or 5.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

Figure 1:
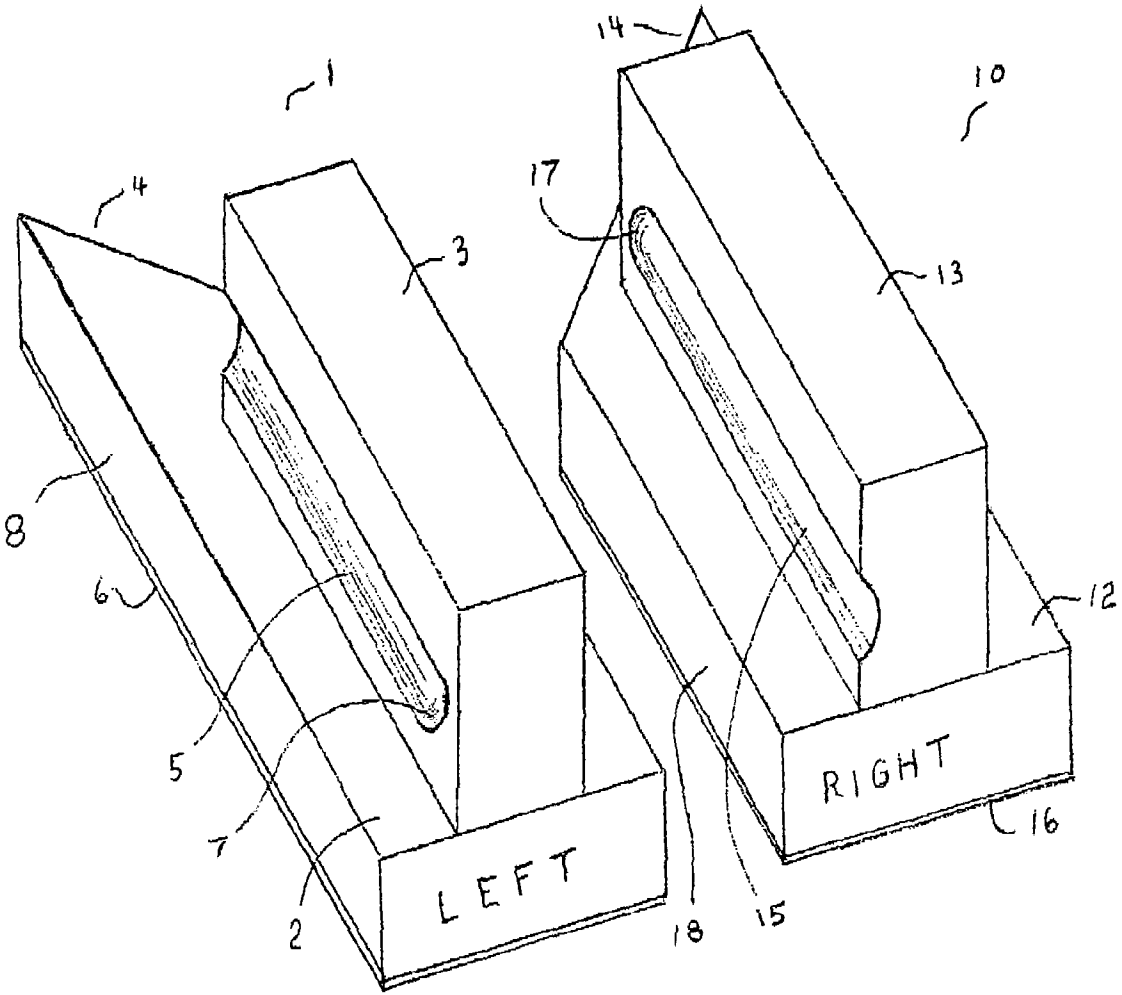
FIG. 1 is a perspective view of the mirror image pair of sanding blocks of this invention.

FIG. 1 shows the mirror image pair of sanding blocks of this invention, block 1 for the left hand and block 10 for the right hand. Block 1 has base 2 with front sloping end 4 and grasp handle 3. Box cove channel 5 on the long side 8 of base 2 has stop 7 at the rear for the third, fourth or fifth finger tip. The user's field conditions and other work variables dictate to the user which finger engages the rear stop 7. Any fingers rearward of a finger engaging rear stop 7 are tucked inward toward the palm of the user's hand, as in making a fist with the user's hand.

The abrasive surface 6 is at the bottom of base 2. Block 10, has base 12 with front sloping end 14, and grasp handle 13. Box cove channel 15 on the short side 18 of base 12 has stop 17 at the front for the thumb. Abrasive surface 16 is on the bottom of base 12.

Figure 3:
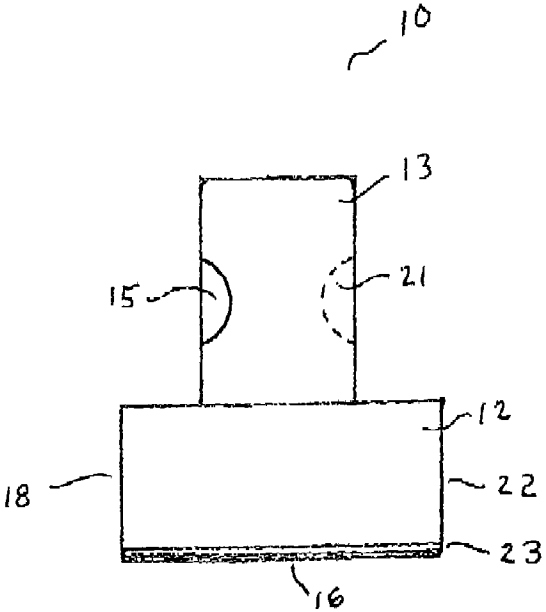
FIG. 3 is a rear end elevation of the sanding block for right hand use.
Figure 2:
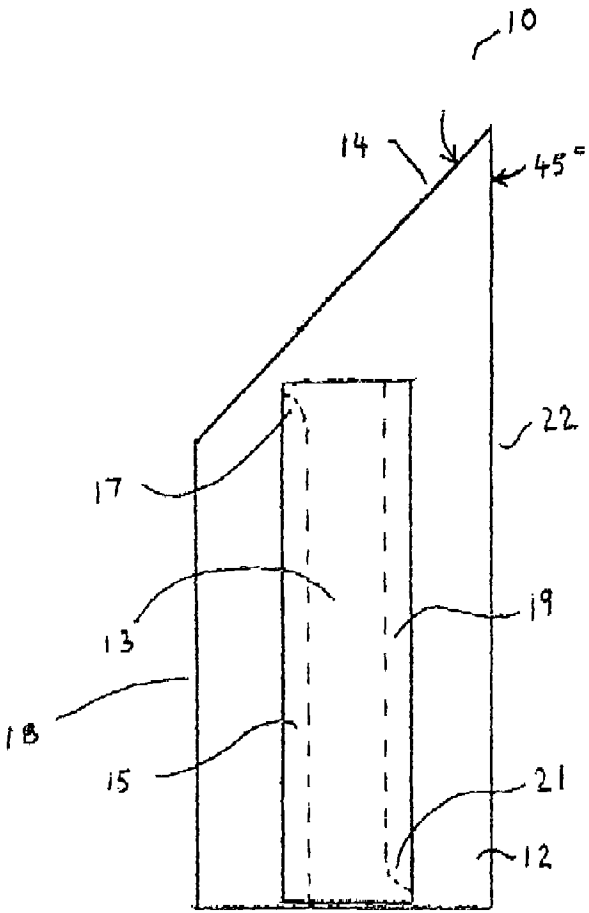
FIG. 2 is a top plan view of the sanding block for right hand use.

FIGS. 2 and 3 are top and end views respectively of right handed block 10 for right hand use. Block 1 would be an identical mirror image. Here box cove channel 19 of block 10 which is provided with stop 21 at the rear thereof for the third, fourth or fifth finger, is illustrated on the long side 22 of base 12 of right handed block 10. These features were not visible in the view of FIG. 1. Layer 23 is the hook and loop (e.g. VELCRO®) layer for attachment of abrasive material 16 to right handed block 10.

Preferably, sloping edges 4 and 14 have their distal outer edge at the end of long sides 8 and 22 respectively.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A right handed sanding block and a left handed sanding block which can be provided individually or as a mirror image pair of right-hand and left-hand sanding blocks comprising:

a right handed sanding abrasive block and a left-handed sanding abrasive block;

each said sanding abrasive block having a fastening surface engaging a replaceable sanding pad, each said sanding abrasive block having an upwardly extending grasp handle to fit the respective right or left hand of a user;

said grasp handle of each said sanding abrasive block having a pair of cove box channels to fit the fingers of the user, said cove box channels having respective forward and rear finger stops, wherein said forward stop is on an opposite side of said grasp handle from said rear stop, said channel positions being reversed for said right hand and left hand sanding abrasive blocks;

said forward stop of each sanding abrasive block defining a natural resting position for the thumb;

each said sanding abrasive block having a front vertical surface of each grasp handle acting as a natural rest position for the index finger;

each said sanding abrasive block having a rear finger stop acting as a natural rest position for a tip of one of the user's third, fourth or of the smallest fifth finger;

each said sanding abrasive block having a base in the shape of a truncated rectangle with the front end cut off at an acute angle; and, each said sanding abrasive block having a short side coinciding with a side of said grasp handle on which the thumb rests, providing other-hand clearance when the other hand of the user grasps the work piece.

2. A sanding block hand tool for manual fine abrasion, wherein said block is specifically for use with the user's right hand, comprising:

an elongated longitudinally disposed grasp handle having a sanding block extending downwardly therefrom, the block having a substantially rectangular shape with parallel respective left and right sides, and wherein said left side is shorter than said right side and said right side is longer than said left side, the block having a rear side extending between and perpendicular to said shorter left side and said longer right side, and, said block having an angled forward side extending between said shorter left side and said longer right side wherein an acute angle is subtended between said angled forward side and said longer right side of said block; and wherein:

said block has a generally rectangular-shaped flat bottom, said flat bottom being bordered by said shorter left side, said longer right side, said rear side and said angled forward side; said flat bottom having the hook portion of loop and hook fastener means mounted thereupon for accepting a sheet of matching-shaped abrasive wherein:

said abrasive is provided with the loop portion of the hook-and-loop fastener means for removable attachment of the abrasive to said flat bottom of said block; and wherein:

said longitudinal grasp handle is generally disposed substantially at the mid-point between said shorter left side and said longer right side and is generally disposed parallel to said sides; and wherein:

said grasp handle is generally shaped as a rectangular block having a narrow rear side, a narrow longitudinally elongated top side and elongated and vertically wide left and right sides extending between a forward side of said handle to said rear side so as to fit comfortably in the right hand of a user; and wherein:

said grasp handle vertically wide left and right sides have respective longitudinally disposed cove box channels therein for comfortably accepting the fingers of a user's right hand; and wherein said cove box channels are located substantially in the vertical center of said vertical width of said respective grasp handle left and right sides; and wherein:

said cove box channels extend between a forward end and a rear end, said cove box channel forward and rear ends corresponding with the forward and rear sides of said longitudinal grasp handle; and wherein:

said left side cove box channel has a comfortable stop near its forward end and said right side cove box channel has a comfortable finger stop near its rear end so that the user's right thumb fits comfortably into the left side cove box channel and the user's choice of the remaining fingers 2, 3, 4, and 5 fit comfortably into the right side cove box channel, said left side cove stop for stopping the users right thumb and said right side cove box channel for stopping the users chosen right finger 3, 4 or 5.

3. A sanding block hand tool for manual fine abrasion, wherein said block is specifically for use with the user's left hand, comprising:

an elongated longitudinally disposed grasp handle having a sanding block extending downwardly therefrom, the block having a substantially rectangular shape with parallel respective left and right sides, and wherein said right side is shorter than left side and said left side is longer than said right side, the block having a rear side extending between and perpendicular to said shorter right side and said longer left side, and, said block having an angled forward side extending between said shorter right side and said longer left side wherein an acute angle is subtended between said angled forward side and said longer left side of said block; and wherein:

said block has a generally rectangular-shaped flat bottom, said flat bottom being bordered by said shorter right side, said longer left side, said rear side and said angled forward side; said flat bottom having the hook portion of loop and hook fastener means mounted thereupon for accepting a sheet of matching-shaped abrasive wherein said abrasive is provided with the loop portion of hook-and-loop fastener means for removable attachment of the abrasive to said flat bottom of said block; and wherein:

said longitudinal grasp handle is generally disposed substantially at the mid-point between said shorter right side and said longer left side and is generally disposed parallel to said sides; and wherein:

said grasp handle is generally shaped as a rectangular block having a narrow rear side, a narrow longitudinally elongated top side and elongated and vertically wide left and right sides extending between a forward side of said handle to said rear side so as to fit comfortably in the left hand of a user; and wherein:

said grasp handle vertically wide left and right sides have respective longitudinally disposed cove box channels therein for comfortably accepting the fingers of a user's left hand; and wherein said cove box channels are located substantially in the vertical center of said vertical width of said respective grasp handle left and right sides; and wherein:

said cove box channels extend between a forward end and a rear end, said cove box channel forward and rear ends corresponding with the forward and rear sides of said longitudinal grasp handle; and wherein:

said right side cove box channel has a comfortable stop near its forward end and said left side cove box channel has a comfortable finger stop near its rear end so that the user's left thumb fits comfortably into the right side cove box channel and the user's choice of remaining left hand fingers 2, 3, 4, and 5 fit comfortably into the left side cove box channel, said right side cove stop for stopping the user's left thumb and said left side cove box channel for stopping the user's chosen left finger 3, 4 or 5.

4. A pair of mirror image sanding blocks comprising:

a sanding block hand tool for manual fine abrasion, wherein said block is specifically for use with the user's right hand, comprising:

an elongated longitudinally disposed grasp handle having a sanding block extending downwardly therefrom, the block having a substantially rectangular shape with parallel respective left and right sides, and wherein said left side is shorter than said right side and said right side is longer than said left side, the block having a rear side extending between and perpendicular to said shorter left side and said longer right side, and, said block having an angled forward side extending between said shorter left side and said longer right side wherein an acute angle is subtended between said angled forward side and said longer right side of said block; and wherein:

said block has a generally rectangular-shaped flat bottom, said flat bottom being bordered by said shorter left side, said longer right side, said rear side and said angled forward side; said flat bottom having the hook portion of loop and hook fastener means mounted thereupon for accepting a sheet of matching-shaped abrasive wherein said abrasive is provided with the loop portion of the hook-and-loop fastener means for removable attachment of the abrasive to said flat bottom of said block; and wherein:

said longitudinal grasp handle is generally disposed substantially at the mid-point between said shorter left side and said longer right side and is generally disposed parallel to said sides; and wherein:

said grasp handle is generally shaped as a rectangular block having a narrow rear side, a narrow longitudinally elongated top side and elongated and vertically wide left and right sides extending between a forward side of said handle to said rear side so as to fit comfortably in the right hand of a user; and wherein:

said grasp handle vertically wide left and right sides have respective longitudinally disposed cove box channels therein for comfortably accepting the fingers of a user's right hand; and wherein said cove box channels are located substantially in the vertical center of said vertical width of said respective grasp handle left and right sides; and wherein:

said cove box channels extend between a forward end and a rear end, said cove box channel forward and rear ends corresponding with the forward and rear sides of said longitudinal grasp handle; and wherein:

said left side cove box channel has a comfortable stop near its forward end and said right side cove box channel has a comfortable finger stop near its rear end so that the user's right thumb fits comfortably into the left side cove box channel and the user's choice of the remaining fingers 2, 3, 4, and 5 fit comfortably into the right side cove box channel, said left side cove stop for stopping the user's right thumb and said right side cove box channel for stopping the user's chosen right finger 3, 4 or 5;

a sanding block hand tool for manual fine abrasion, wherein said block is specifically for use with the users left hand, comprising:

an elongated longitudinally disposed grasp handle having a sanding block extending downwardly therefrom, the block having a substantially rectangular shape with parallel respective left and right sides, and wherein said right side is shorter than left side and said left side is longer than said right side, the block having a rear side extending between and perpendicular to said shorter right side and said longer left side, and, said block having an angled forward side extending between said shorter right side and said longer left side wherein an acute angle is subtended between said angled forward side and said longer left side of said block; and wherein:

said block has a generally rectangular-shaped flat bottom, said flat bottom being bordered by said shorter right side, said longer left side, said rear side and said angled forward side; said flat bottom having the hook portion of loop and hook fastener means mounted thereupon for accepting a sheet of matching-shaped abrasive wherein said abrasive is provided with the loop portion of hook-and-loop fastener means for removable attachment of the abrasive to said flat bottom of said block; and wherein:

said longitudinal grasp handle is generally disposed substantially at the mid-point between said shorter right side and said longer left side and is generally disposed parallel to said sides; and wherein:

said grasp handle is generally shaped as a rectangular block having a narrow rear side, a narrow longitudinally elongated top side and elongated and vertically wide left and right sides extending between a forward side of said handle to said rear side so as to fit comfortably in the left hand of a user; and wherein:

said grasp handle vertically wide left and right sides have respective longitudinally disposed cove box channels therein for comfortably accepting the fingers of a user's left hand; and wherein said cove box channels are located substantially in the vertical center of said vertical width of said respective grasp handle left and right sides; and wherein:

said cove box channels extend between a forward end and a rear end, said cove box channel forward and rear ends corresponding with the forward and rear sides of said longitudinal grasp handle; and wherein:

said right side cove box channel has a comfortable stop near its forward end and said left side cove box channel has a comfortable finger stop near its rear end so that the user's left thumb fits comfortably into the right side cove box channel and the users choice of remaining left hand fingers 2, 3, 4, and 5 fit comfortably into the left side cove box channel, said right side cove stop for stopping the users left thumb and said left side cove box channel for stopping the users chosen left finger 3, 4 or 5.

5. A conveniently graspable sanding block hand tool for enabling a user to engage in manual fine control of abrasion on work pieces, comprising:

a block for retaining an abrasive sheet on a bottom side thereof, said block being about three quarters of an inch thick, said block having front, rear, right and left sides and a top, wherein said right and left sides are longer than said rear side; and wherein said block has a grasp handle extending longitudinally upward from said top of block, said grasp handle extending along an imaginary line centered between said left and right sides and running in a direction between said front and said rear of said block; and wherein said grasp handle has a pair of right and left side oppositely disposed vertical faces; and wherein said vertical faces respectively each having longitudinally extending cove box channels to receive the fingers of a user during use of the block.

6. The sanding block of claim 5 wherein said right and left sides of said block are parallel to each other, wherein said right and left side are respectively perpendicularly disposed to said rear side and wherein said front side is subtended by different respective non-90-degree angles with regard to its respective intersections with said respective right and left sides.

7. The sanding block of claim 6 wherein said respective right and left side cove box channels each have a finger stop for improving the stability of the user's grasp.

8. The sanding block of claim 7 wherein said finger stops in said cove box channels are alternately disposed so that one finger stop is disposed near the front side of said block and the respective opposite side finger stop is disposed near said rear end of said block.

9. The sanding block of claim 8 wherein said cove box channel of said right-side of said grasp handle face has a finger stop near said rear end of said block; and wherein said cove box channel of said left-side of said grasp handle face has a finger stop near said front end of said block; and wherein the angle subtended between said left side of said block and said front side of said block is an obtuse angle; and wherein the angle subtended between said right side of said block and said front side of said block is an acute angle.

10. The sanding block of claim 9 wherein said acute angle is about 45 degrees and said obtuse angle is about 135 degrees.

11. The sanding block of claim 8 wherein said cove box channel of said left-side of said grasp handle face has a finger stop near said rear end of said block; and wherein said cove box channel of said right-side of said grasp handle face has a finger stop near said front end of said block; and wherein the angle subtended between said left side of said block and said front side of said block is an acute angle; and wherein the angle subtended between said right side of said block and said front side of said block is an obtuse angle.

12. The sanding block of claim 11 wherein said acute angle is about 45 degrees and said obtuse angle is about 135 degrees.

13. A sanding block hand tool for fine control of manual abrasion, comprising a flat sanding block having a top, a bottom, right, left, rear and front sides, with a grasp handle projecting vertically upward from said top, wherein said right and left sides are parallel to each other and said rear side extends perpendicularly between said right and left sides respectively; and wherein said grasp handle of each said sanding abrasive block having a pair of cove box channels to fit the fingers of the user, said cove box channels having respective forward and rear finger stops, wherein said forward stop is on an opposite side of said grasp handle from said rear stop, said right and left sides are of different lengths and said front side extends angularly between said respective right and left sides, said angular front side comprising a clearance safety harbor for the hand of a user grasping a work piece to be sanded.

14. The sanding block of claim 13 wherein said right side is longer than said left side and the angle subtended by said left side and said front side is an obtuse angle and the angle subtended by said right side and said front side is an acute angle.

15. The block of claim 14 wherein said acute angle is about 45 degrees and said obtuse angle is about 135 degrees.

16. The sanding block of claim 13 wherein said left side is longer than said right side and the angle subtended by said left side and said front side is an acute angle and the angle subtended by said right side and said front side is an obtuse angle.

17. The block of claim 15 wherein said acute angle is about 45 degrees and said obtuse angle is about 135 degrees.

* * * * *